United States Patent [19]

Ogawa et al.

[11] Patent Number: 4,498,759

[45] Date of Patent: Feb. 12, 1985

[54] CONTINUOUS VARIABLE MAGNIFICATION-TYPE COPYING MACHINE CAPABLE OF ENLARGING AND CONTRACTING AN IMAGE

[75] Inventors: Ryota Ogawa; Ikuo Negoro, both of Tokyo, Japan

[73] Assignee: Asahi Kogaku Kogyo Kabushiki Kaisha, Tokyo, Japan

[21] Appl. No.: 422,500

[22] Filed: Sep. 23, 1982

[30] Foreign Application Priority Data

Sep. 24, 1981 [JP] Japan ..... 56-150916

[51] Int. Cl.[3] ..... G03G 15/00

[52] U.S. Cl. ..... 355/8; 355/55

[58] Field of Search ..... 355/8, 11, 51, 57, 60, 355/66, 71, 55

[56] References Cited

U.S. PATENT DOCUMENTS 3,614,222 10/1971 Post et al. ..... 355/8

4,279,497 7/1981 Satomi ..... 355/8

*Primary Examiner*—A. C. Prescott

*Attorney, Agent, or Firm*—Sughrue, Mion, Zinn, Macpeak & Seas

[57] ABSTRACT

A continuous, variable magnification-type copying machine which is capable of enlarging and contracting an image includes a full-speed mirror, a half-speed mirror system and a single lens. A scanning starting position of the full-speed mirror, the half-speed mirror system, and the lens is controlled by a stepping motor to achieve desired enlarging and contracting magnifications of the image, as well as a life-size magnification of the image.

18 Claims, 15 Drawing Figures

CONTINUOUS VARIABLE MAGNIFICATION-TYPE COPYING MACHINE CAPABLE OF ENLARGING AND CONTRACTING AN IMAGE

BACKGROUND OF THE INVENTION

1. Field of the Invention

This invention relates to a half-speed mirror moving mechanism and a lens moving mechanism which allows continuous variation of magnification in a variable magnification-type copying machine in which the magnification can be varied from an enlarging magnification to a contracting magnification and vice versa.

2. Description of the Prior Art

Some of the conventional, variable magnification-type copying machines employ a zoom lens system such as that disclosed by Japanese Patent Application Nos. 145988/1980 and 37841/1980 which have been filed by the present Applicant. The zoom lens system needs two lens groups which are operated independently. Accordingly, a copying machine using the zoom lens system is disadvantageous because it requires a large number of lenses and is intricate in design.

Japanese Patent Application Laid-Open Nos. 77762/1980 and 77763/1980 disclose a variable magnification-type copying machine which is capable of several magnifications in which, as shown in FIG. 1, the scanning starting position of a half-speed mirror M12 and the position of a lens L10 are changed for each change in magnification. In the copying machine which has a full-speed mirror M11 and the half-speed mirror M12 arranged as shown in FIG. 1, as the half-speed mirror M12 is moved from the point T to the point T′, an original illuminating point is shifted from the position t to the position t′. The movement of the illuminating point must be corrected for each magnification. Furthermore, the optical axis on the full-speed mirror M11 is shifted and, therefore, the full-speed mirror must be large. If it is desired to provide an enlarging magnification larger than one (a magnification of one representing a life-size magnification), the lens L10 must be moved towards the half-speed mirror M12. In this case, the lens may be brought into contact with the half-speed mirror, or the lens may block the optical half of the half-speed mirror, thus making it impossible to provide a sufficiently large enlarging magnification in practice. Furthermore, since the scanning starting position of the half-speed mirror M12 and the position of the lens L10 are limited, it is impossible to continuously vary the magnification. In addition, the prior art copying machine is intricate in construction.

SUMMARY OF THE INVENTION

In view of the foregoing, a first object of the present invention is to provide a variable magnification-type copying machine which is capable of continuously enlarging and contracting an image. The copying machine of the present invention utilizes a single focus lens so that fewer lenses are required than in a zoom lens system. The single focus lens used in the present invention is utilized to change the scanning starting position of the half-speed mirror continuously according to the desired magnification. Also, the copying machine of the present invention is simple in construction and low in manufacturing cost.

A further advantage of the present invention is that the half-speed mirror is made up of two mirrors which are aligned perpendicularly to each other, thus eliminating the shift of the optical axis on the original which occurs when the magnification is changed. Also, the half-speed mirror scanning distance can be set to a necessary minimum value when an enlarging magnification is desired. Accordingly, the lens movement region can be extended toward the half-speed mirror to obtain an enlarging magnification without increasing the size of the entire copying machine.

DESCRIPTION OF THE PREFERRED EMBODIMENTS

A half-speed mirror moving mechanism for moving a scanning starting position of a half-speed mirror, as well as a lens moving mechanism for moving the position of a lens as the magnification is changed, will be described below. However, to aid in understanding the invention, first, the scanning starting position of the half-speed mirror and the position of the lens for changing the magnification will be described with reference to FIGS. 2 through 5.

Figure 1:
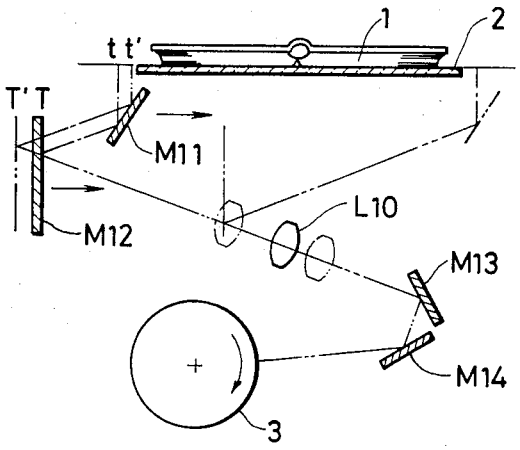
FIG. 1 is a diagram illustrating a conventional magnification varying device.
Figure 2:
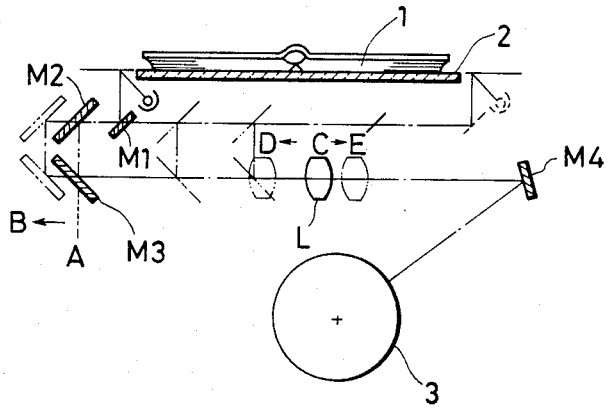
FIG. 2 is a diagram showing the arrangement of mirrors and a lens according to the present invention.

FIG. 2 is a diagram outlining a copying machine to which the technical concept of the present invention is applicable. More specifically, in the copying machine of FIG. 2, the image of an original 1, which is placed on a contact glass plate 2, is formed on a photo-sensitive drum 3 using a series of mirrors M1, M2, M3, M4 and a lens L. The drum 3 is rotated at a constant speed, regardless of the magnification chosen. A full-speed mirror M1 scans the original 1 as the original is illuminated. Half-speed mirrors M2 and M3 are disposed perpendicular to each other for scanning a distance equal to half the distance scanned by the full-speed mirror, and the half-speed mirrors scan at a speed which is half of the scanning speed of the full-speed mirror. To vary the magnification, the full-speed mirror M1 is held stationary, the scanning starting position of the half-speed mirrors M2 and M3 is moved to change the distance between the object and an image, and the position of the lens L is moved. This changes the magnification of the image of the original formed on the photo-sensitive drum 3. In addition, the scanning speeds and the scanning distances of the full-speed mirror M1 and the half-speed mirrors M2 and M3 are changed according to the varied magnification.

Figure 3:
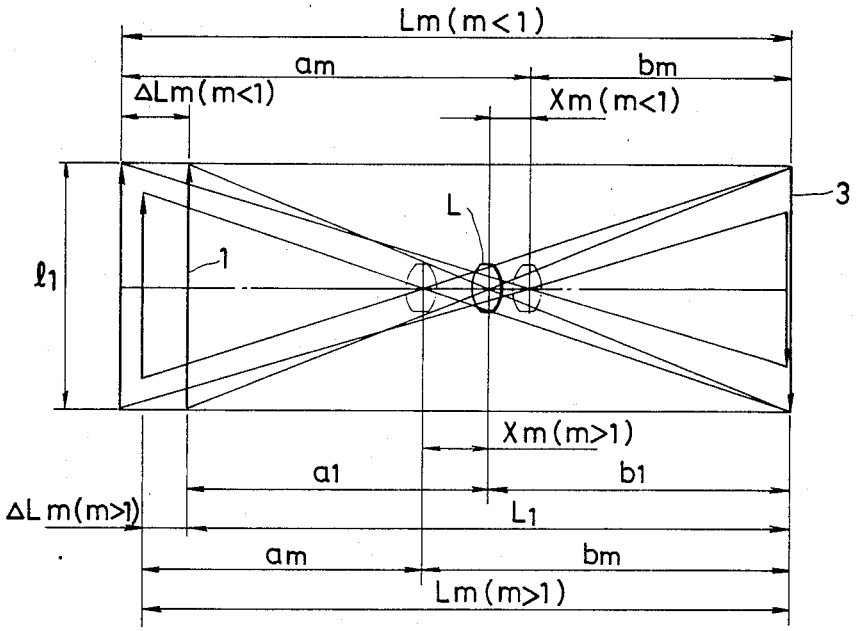
FIG. 3 is a theoretical diagram indicating object-image distances using various lens positions.

FIG. 3 is a top view of the copying machine shown in FIG. 2 with the mirrors omitted. In other words, FIG. 3 is a theoretical diagram indicating the positional relationships between the lens L, the original 1 and the photo-sensitive drum 3 when the magnification is changed. The amount of movement of the scanning starting position of the half-speed mirrors M2 and M3, and the amount of movement of the lens L at the time of magnification variation, will be described with reference to life-size magnification.

First, the scanning starting position of the half-speed mirrors M2 and M3 will be described.

If the varied magnification is represented by 1:m, the focal length of the lens L is represented by f, the distance between the lens L and the object is represented by $a_m$, and the distance between the lens L and the image is represented by $b_m$, the distance between an object and the image (hereinafter referred to as "the object-image distance") $L_m$ can be found as follows:

$$m = b_m/a_m$$

$$\frac{1}{a_m} + \frac{1}{b_m} = \frac{1}{f} \quad Lm = a_m = b_m$$

Therefore, $$L_m = \frac{(m+1)^2}{m} f$$

Accordingly, an increment or difference $\Delta L_m$ between the object-image distance $L_1$ which results in life-size magnification, and the object-image distance $L_m$ which results in a given magnification m, is:

$$\Delta L_m = L_m - L_1 \tag{1}$$

From $L_1 = 4f$ $$\Delta L_m = \frac{(m-1)^2}{m} f \tag{12}$$

When $m > 1$, $\Delta L_m > 0$, and when $m < 1$, $\Delta L_m > 0$, accordingly, the increment $\Delta L_m$ is positive for both enlarging magnifications ($m > 1$) and contracting magnifications ($m < 1$).

Accordingly, in FIG. 2, the scanning starting position of the half-speed mirrors M2 and M3, when the magnification is varied from life-size, is always shifted in the direction of the arrow B. From FIG. 2, it is apparent that the amount of movement of the half-speed mirrors M2 and M3 is $\Delta L_m/2$ since this amount of movement increases the object-image distance by $\Delta L_m$.

Next, the amount of movement of the lens is described.

The amount of movement $X_m$, in the direction of the optical axis of the lens L when the magnification m is varied from 1 (the life-size magnification), is as follows:

$$X_m = b_m - b_1$$

$$b_m = \frac{m}{m+1} L_m = (m+1)f$$

$$b_1 = L_1/2 = 2f$$

where $b_1$ represents the distance between the lens L and the image for a life-size magnification.

Therefore, $$X_m = (m-1)f \tag{2}$$

when $m > 1$, $X_m > 0$, and when $m > 1$, $X_m < 0$. Therefore, in FIG. 2, the life-size magnification position C of the lens L is shifted in the direction of the arrow D when an enlarging magnification ($m > 1$) is desired, and the lens L is shifted in the direction of the arrow E when a contracting magnification ($m < 1$) is desired.

Figure 4:
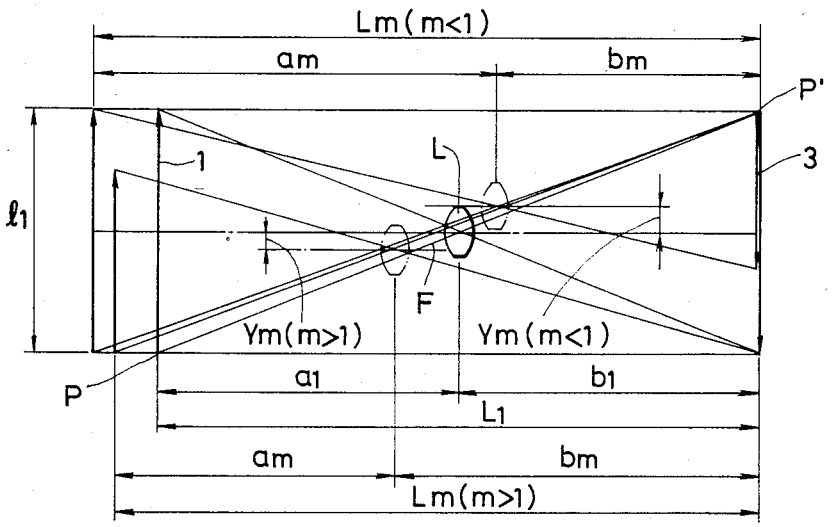
FIG. 4 is a theoretical diagram indicating object-image distances using various lens positions in which a lens is moved in a direction perpendicular to the optical axis for varying magnifications.

Similarly, as in the case of FIG. 3, FIG. 4 is a top view of the copying machine of FIG. 2. More specifically, FIG. 4 is a theoretical diagram showing the lens L, which is shifted in a direction perpendicular to the optical axis, so that the image of one edge P of the original 1 is formed on one end P' of the photo-sensitive drum 3 for all magnifications.

The amount of movement $Y_m$ of the lens L from the life-size magnification position in a direction perpendicular to the optical axis, when the magnification is varied, is as follows:

$$Y_m = \frac{a_m}{L_m} l_1 - \frac{l_1}{2}$$

where $l_1$ is the maximum width of an original.

$$a_m = \frac{L_m}{m+1}$$

Therefore, $$Y_m = -\frac{l_1}{2} \frac{m-1}{m+1} \tag{3}$$

Accordingly, with respect to the position of the lens L, $X_m$ and $Y_m$ can be satisfied simultaneously. That is, the lens L can be moved along the curve F in FIG. 4 so that the image of one edge P of the original 1 can be formed at one end P' of the photo-sensitive drum for all magnifications.

As is apparent from the above description, when the magnification is changed from the life-size magnification, the object-image distance is increased by $\Delta L_m$ by moving the scanning starting position of the half-speed mirrors M2 and M3 while the full-speed mirror is maintained stationary. At the same time, the lens L is moved a distance $X_m$ in the direction of the optical axis.

In a copying machine in which the image of one edge of an original is formed on one end of the photo-sensitive drum 3, even in the case of a varied magnification, in addition to the above-described movement distances $\Delta L_m$ and $X_m$, the lens L is also moved by a distance $Y_m$ in a direction perpendicular to the optical axis.

The scanning speeds and the scanning distances of the full-speed mirror M1 and the half-speed mirrors M2 and M3 when the magnification is varied will now be described.

As described in the specification of Japanese Patent Application No. 174989/1980, filed by the present Applicant, the photo-sensitive drum 3 is generally rotated at a constant speed in a copying operation. Therefore, if the peripheral speed of the drum 3 is represented by V, the scanning speed $V_m$ of the full-speed mirror M1 and the scanning speed $V_m'$ of the half-speed mirrors M2 and M3 is as follows when the magnification m is varied from the life-size magnification:

$$V_m = \frac{V}{m} \tag{4}$$

$$V_m' = \frac{V_m}{2} = \frac{V}{2m}$$

Since the size of the photo-sensitive drum 3 is limited, the maximum obtainable copying size is used as a reference. Thus, the size of an original is limited according to a chosen varied magnification, and the full-speed mirror M1 should scan only the limited original size range. Therefore, if the length of the maximum copying size is represented by $S_0$ and the margin for acceleration and deceleration of the mirror scanning is represented by $\Delta S$, then the scanning distance $S_m$ of the full-speed mirror M1, which is required for obtaining the maximum copying size from an original for which a magnification has been specified, is:

$$S_m = S_O/m + \Delta S \tag{5}$$

Thus, the scanning distance $S_m$ of the full-speed mirror M1 is inversely proportional to the magnification m. Therefore, the scanning distance $S_m$ becomes smaller as the magnification is enlarged. In a copying machine in which the maximum copying size is equal to the maximum original size, the upper value of the scanning distance $S_m$ is limited by the maximum original size. Therefore, $S_m$, which corresponds to the change from a life-size magnification to a contracting magnification, is:

$$S_m = S_O + \Delta S (m \leqq 1) \tag{6}$$

Thus, the scanning distance of the half-speed mirrors M2 and M3 is always half of $S_m$.

Figure 5:
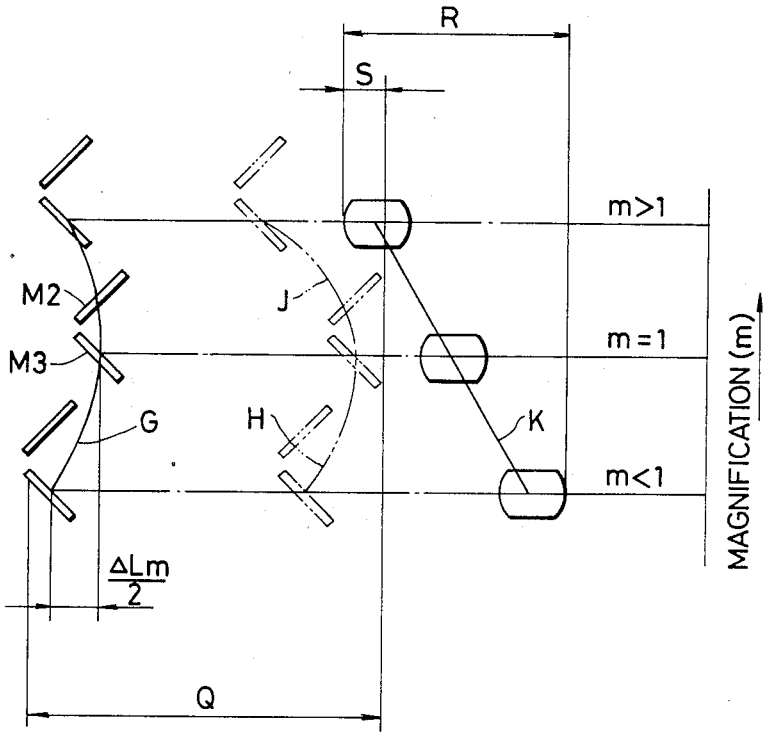
FIG. 5 is a diagram showing the positional relationships between the half-speed mirrors and a lens.

FIG. 5 shows scanning distances of the half-speed mirrors M2 and M3, movements of the scanning starting position, and movements of the lens according to various magnifications. In FIG. 5, the horizontal axis represents distances (lengths), and the vertical axis represents magnifications (m). The scanning starting position of the half-speed mirrors M2 and M3 moves along the curve G as the magnification m is varied, and the scanning finishing position of the half-speed mirrors M2 and M3 moves along the curve H-J as the magnification is varied. In addition, the position of the lens L is moved along the straight line K as the magnification is varied. When the magnification is enlarged ($m > 1$), the scanning finishing position of the half-speed mirrors M2 and M3 is moved backward, and, accordingly, the movement region R of the lens L can be increased toward the half-speed mirrors M2 and M3 for enlarged magnifications, thus increasing an overall enlarging magnification. As a result, the movement of the region Q of the half-speed mirrors M2 and M3 and the movement region R of the lens L overlap in the region S as the magnification is reduced to a contracting magnification. This means that the space in the copying machine is effectively utilized. Accordingly, the enlarging magnification can be increased without increasing the size of the copying machine.

The principle of controlling the half-speed mirror moving mechanism and the lens moving mechanism, according to the present invention, is as described above. Now, a half-speed mirror moving mechanism will be described according to this principle.

Figure 6:
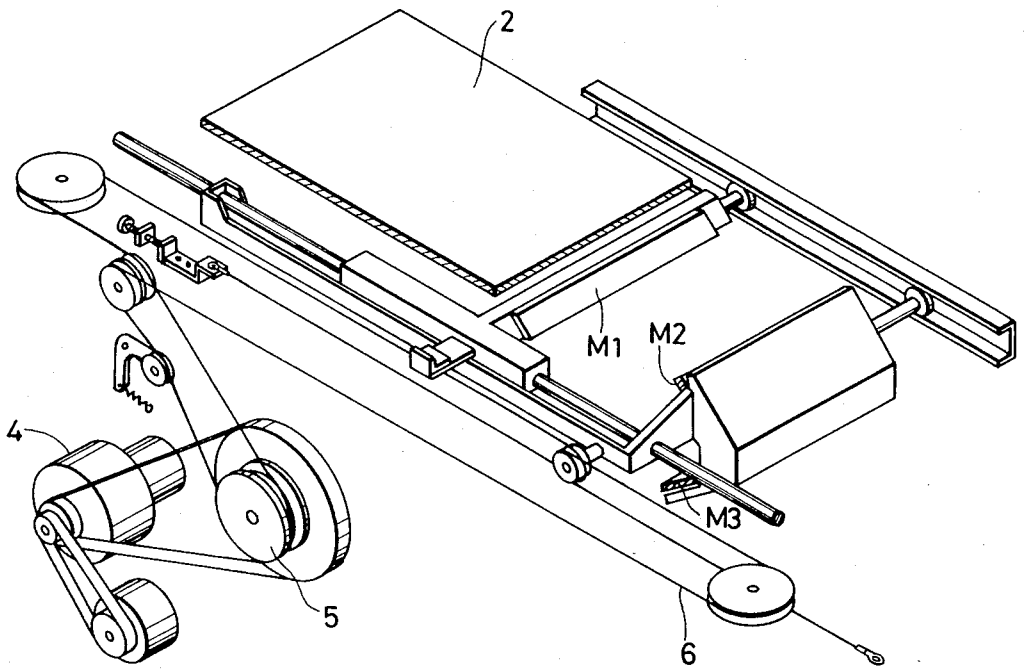
FIG. 6 is a perspective view of a mirror scanning control mechanism.

FIG. 6 shows a mirror scanning control mechanism forming the subject matter of U.S. Pat. No. 4,436,416 by the present Applicant. The mechanism of FIG. 6 continuously varies the scanning speeds and the scanning distances of the mirrors M1, M2 and M3 as the magnification is varied. The mechanism includes a drive pulley 5 which is turned by a drive motor, the speed and position of which can be controlled, and a wire 6 is sliplessly wound around the drive pulley 5 and several idler pulleys. The idler pulleys are used in combination to select suitable scanning speeds and suitable scanning distances for the mirrors so that the mirrors can scan while illuminating the original without changing the object-image distance during the scan.

Figure 7:
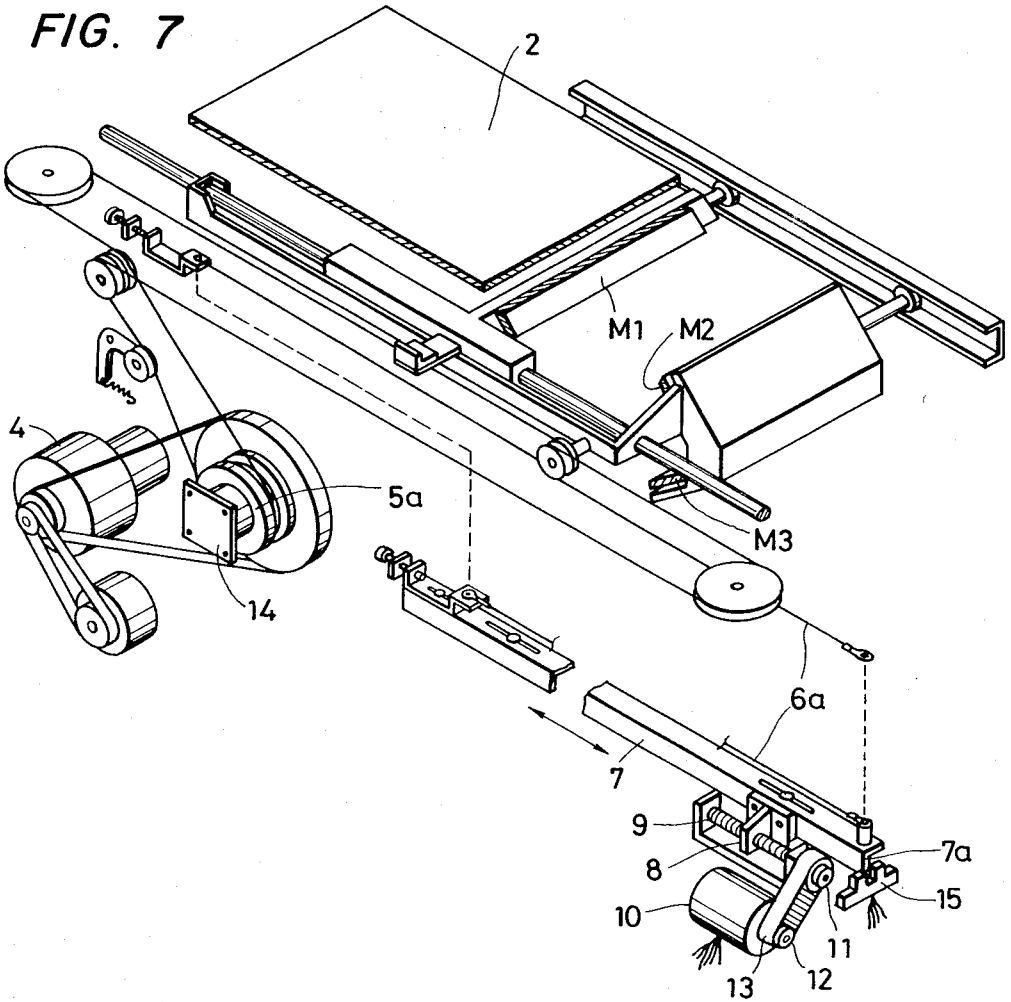
FIG. 7 is a perspective view of one embodiment of a half-speed mirror moving mechanism utilized in the present invention.

FIG. 7 shows one embodiment of a half-speed mirror moving mechanism which can be added to the mirror scanning mechanism in FIG. 6. In FIG. 7, the scanning starting position of the half-speed mirrors M2 and M3 is moved by a distance $\Delta L_m/2$ by using a conventional numerical control motor, such as a stepping motor, the position of which can be controlled. Both ends of the wire 6 are fastened to a plate-shaped slide bar 7, and the slide bar 7 is slidably mounted on the body of the copying machine so that it is parallel with the wire rope 6. A feed screw 9 is oriented parallel with the slide bar 7, and the feed screw 9 can be rotated without play in the axial direction. A nut 8 on the slide bar 7 is engaged with the feed screw 9, and a stepping motor 10 is provided on the copying machine body. Timing pulleys 11, 12 and a timing belt 13 are provided for the feed screw 9 and the stepping motor 10 in order to transmit the rotation of the stepping motor 10. Furthermore, a conventional electromagnetic brake 14 is provided for a drive pulley 5*a*, which is similar to the drive pulley 5 shown in FIG. 6. In addition, a conventional position detecting means, such as a conventional photo-interrupter 15, is provided which detects the end 7*a* of the slide bar 7 when the half-speed mirrors' scanning starting position is at the life-size magnification position.

When the scanning starting position of the half-speed mirrors M2 and M3 is set at a desired varied magnification position with the half-speed mirror moving mechanism thus constructed, in order to hold the full-speed mirror M1, the rotation of the drive pulley 5*a* is stopped using the electromagnetic brake 14. Accordingly, movement of the wire rope 6 is stopped. Next, the photo-interruptor 15 detects whether the half-speed mirrors M2 and M3 are at the scanning start position corresponding to the life-size magnification. Then, pulses are applied to the stepping motor 10 to turn the feed screw 9, and the number of pulses correspond to the amount of desired movement $\Delta L_m/2$. The mirrors M2 and M3 are stopped after being moved the distance $\Delta L_m/2$, and the amount of movement $\Delta L_m/2$ of the half-speed mirrors M2 and M3 corresponds to the amount of movement $\Delta L_m$ due to the action of the pulleys. When the half-speed mirrors M2 and M3 are run recklessly in the case of a varied magnification, especially in the case of an enlarging magnification, the electromagnetic brake 14 stops the drive pulley 5*a* quickly to prevent excessive scanning of the half-speed mirrors, thus preventing a collision between the half-speed mirrors M2, M3 and the lens L.

Figure 8:
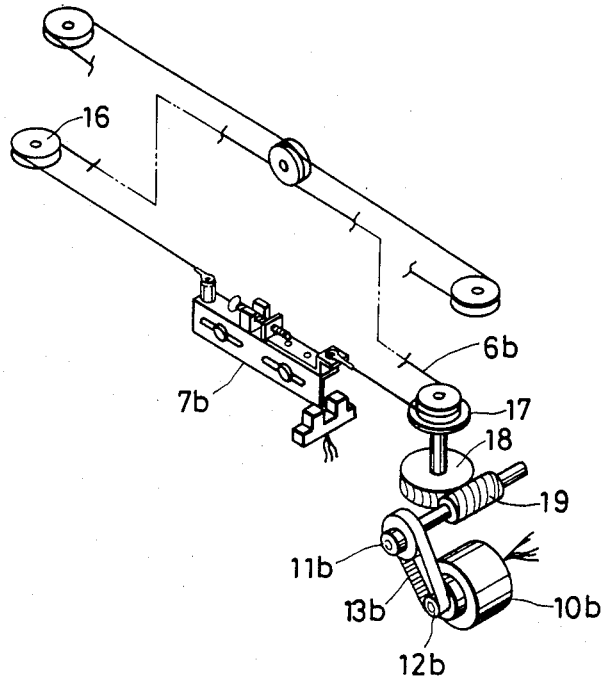
FIG. 8 is a perspective view of another embodiment of a half-speed mirror moving mechanism utilized in the present invention.

FIG. 8 shows another example of a half-speed mirror moving mechanism in which the aforementioned feed screw 9 is not employed. One end portion of a wire 6*b*, which is longer than the wire 6 in FIG. 7, is laid over an idler pulley 16 and fastened to a plate-shaped slide bar 7*b* which is slidable parallel with the wire 6*b*. The other end portion of the wire 6*b* is slidelessly wound on a wire pulley 17 and fastened to the slide bar 7*b* under tension. The rotary shaft of the wire pulley 17 is coupled to a worm wheel 18. The worm wheel 18 is engaged with a worm 19, and the rotation of a stepping motor 10*b* is transmitted through timing pulleys 11*b* and 12*b* and a timing belt 13*b* to the worm 19. As the stepping motor 10*b* is rotated in response to a change in the magnification m, the wire pulley 17 is turned through the timing pulleys 11*b* and 12*b*, the timing belt 13*b*, the worm 19 and the worm wheel 18.

Figure 9:
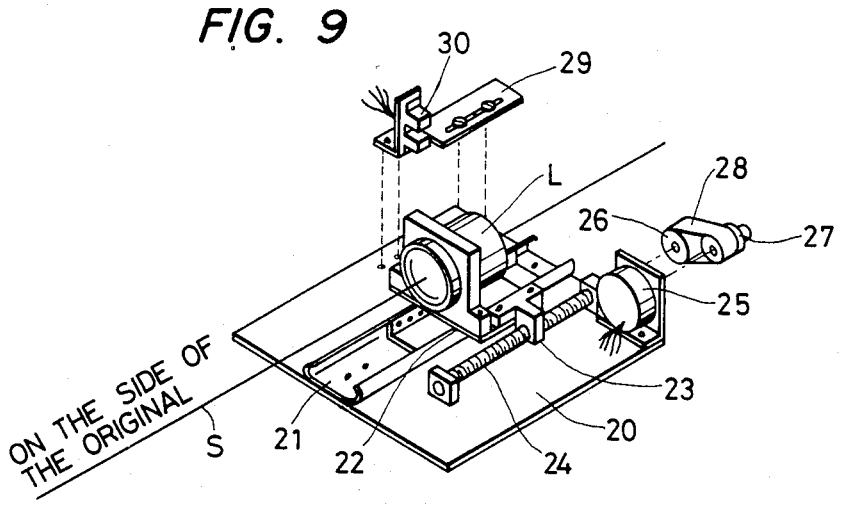
FIG. 9 is a perspective view showing an embodiment of a lens moving mechanism usable in accordance with the present invention.

FIG. 9 shows one embodiment of the lens moving mechanism of the present invention which moves the position of the lens as much as $X_m$, from the life-size magnification position described with reference to FIG. 3, according to a magnification desired. In FIG. 9, reference character S designates the optical axis, and an original is set on the left side of the optical axis S. A conventional linear guide 21 with a platen 22, which reciprocates parallel to the optical axis S without play, is mounted on a base plate which is secured to the copying machine body. A lens L is mounted on the platen 22. Accordingly, the lens L is movable in a direction which is parallel to the optical axis. A nut 23 is provided on the platen 22 so that the platen 22 is parallel to the linear guide 21. The nut 23 is engaged with a feed screw 24 which is parallel to the linear guide 21. The feed screw 24 is rotatable and movable in the axial direction without play, and stepping motor 25 is mounted on the base plate 20. In order to transmit the rotation of the stepping motor 25 into movement of the platen 22 along the optical axis, timing pulleys 26 and 27 and a timing belt 28 are provided for the feed screw 24 and the stepping motor 25. A plate-shaped slit 29 is provided on the platen 22 so that it is adjustable in the direction of the optical axis. The slit 29 is combined with a photo-interruptor 30 on the base plate so that the photo-interruptor 30 detects when the lens L is at the life-size magnification position. The slit 29 is a suitable length so that the life-size magnification and enlarging magnifications (or contracting magnifications) can be detected. Thus, the photo-interruptor 30 can detect whether the lens L is at the life-size magnification position, the contracting magnification side position, or the enlarging magnification side position.

When the lens is set at a desired varied magnification position with the lens moving mechanism thus constructed, first, the life-size magnification position of the lens L is detected by the photo-interruptor 30. Then, pulses are supplied to the stepping motor 25 to turn the screw feed 24. The number of pulses corresponds to an amount of movement $X_m$ of the lens L from the life-size magnification position to the desired varied magnification position. As a result, the lens L is stopped after being moved a distance $X_m$ along the optical axis.

Figure 10:
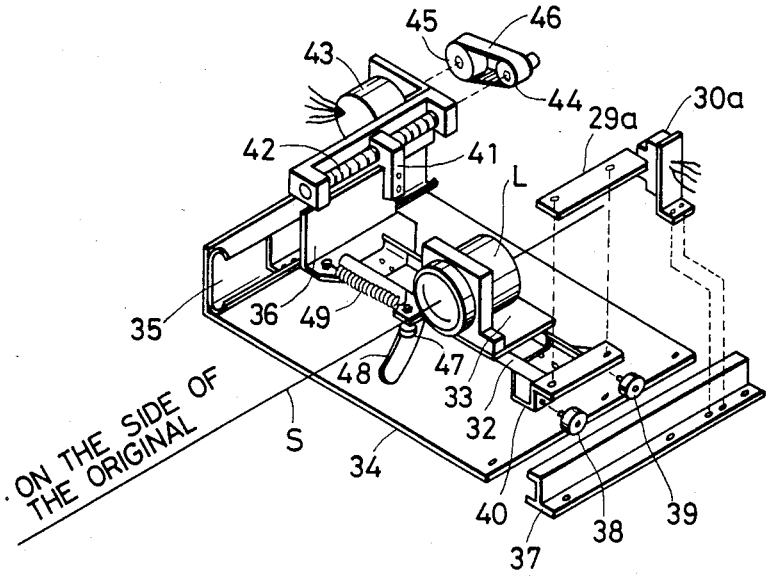
FIG. 10 is a perspective view showing another embodiment of a lens moving mechanism in which an edge of an original is aligned with an end of a photo-sensitive drum.

FIG. 10 shows one example of the lens moving mechanism in which, in order to form the image of one edge of an original on one end of the photo-sensitive drum 3 at a number of varying magnifications, the lens L is moved a distance $X_m$ in the direction of the optical axis and, simultaneously, it is moved a distance $Y_m$ in a direction perpendicular to the optical axis. In FIG. 10, reference character S designates the optical axis of the lens L for the life-size magnification, and an original is set on the left-hand side of the optical axis. The lens L is mounted on the platen 33 of a conventional linear guide 32 which can be moved in a direction perpendicular to the optical axis. One end portion of the linear guide 32 is mounted on a platen 36 of a linear guide 35 which is secured to a base plate 34 in such a manner that it is parallel to the optical axis. The other end portion of the linear guide 32 is mounted on a support plate 40 which has rollers 38 and 39 rolling on a guide rail 37. The guide rail 37 is secured to the base plate 34 in such a manner that it is parallel with the optical axis. Thus, the lens L can move parallel to the optical axis and in a direction perpendicular to the optical axis. The platen 36 has a nut 41 which is engaged with a feed screw 42, and the feed screw 42 is rotatably mounted on the base plate 34 at both ends in such a manner that it is parallel with the linear guide 35. In order to transmit the rotation of a stepping motor 43 (the position of which can be controlled), to the feed screw 42, timing pulleys 44 and 45 and a timing belt 46 are provided between the feed screw 42 and the stepping motor 43. The platen 33 is provided with a roller 47 which is inserted into a lead groove 48 which is cut in the base plate 34. A spring 49 is provided between the platens 36 and 33 so that the roller 47 is pressed against the lead groove 48. The lead groove 48 is in the form of a curve, thus allowing the lens L to move on the curve F in FIG. 4. Therefore, the lens L is moved a distance $X_m$ in the direction of the optical axis by the stepping motor 43, which is necessary in the case of the varied magnification. The lens L is moved a distance $Y_m$ by the lead groove 48 and the roller 47, in a direction perpendicular to the optical axis, by the utilization of the movement $X_m$. Position detecting means comprises a plate-shaped slit 29*a* and a photo-interruptor 30*a*. Similarly, as in the case of FIG. 9, the slit 29*a* is mounted on the support plate 40 in such a manner that it is parallel with the optical axis, and its position is adjustable. The photo-interruptor 30*a* is mounted on the base plate 34 so that it detects magnification positions ranging from the life-size magnification position to the maximum enlarging magnification position (or the maximum contracting magnification position), in combination with the slit 29*a*.

Figure 11:
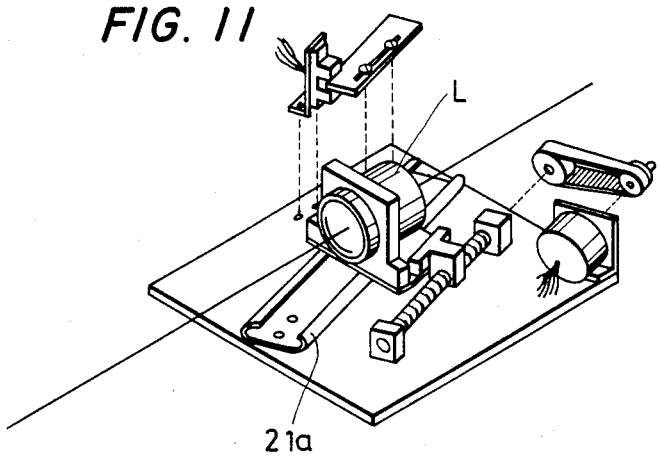
FIG. 11 is a perspective view showing another embodiment of a lens moving mechanism.

FIG. 11 shows an embodiment of a simple lens moving mechanism in which the range of magnification varies from life-size magnification to a contracting magnification, and one linear guide is utilized to move the lens in the direction of the optical axis and in a direction perpendicular to the optical axis.

Figure 12:
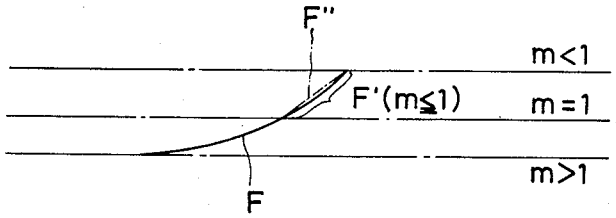
FIG. 12 is a theoretical diagram showing the movement of the lens.

As shown in FIG. 4, the lens L is moved along the curve F according to various magnifications. However, in the case of a copying machine in which the range of magnification is small, for instance, in a copying machine in which the range of magnification is from life-size magnification to a contracting magnification, the lens L is moved along the curve F', as shown in FIG. 12. If it is practical that the image of one edge of an original 1 formed on the photo-sensitive drum 3 be shifted somewhat from one end of the drum 3, then a straight line F'' can be used to approximate the curve F'. Accordingly, a linear guide 21*a* in FIG. 11 is such that the linear guide 21 in the lens moving mechanism in FIG. 9 follows the straight line F''.

In the lens moving mechanism described above, one linear guide is used to move the lens in the direction of the optical axis and in a direction perpendicular to the optical axis. Therefore, the lens moving mechanism is simpler in construction, uses fewer components and is cheaper to manufacture than the lens moving mechanism in FIG. 10. Thus, the lens moving mechanism in FIG. 11 can be effectively employed for a copying machine in which the range of magnification is from life-size magnification to a contracting magnification.

Figure 13:
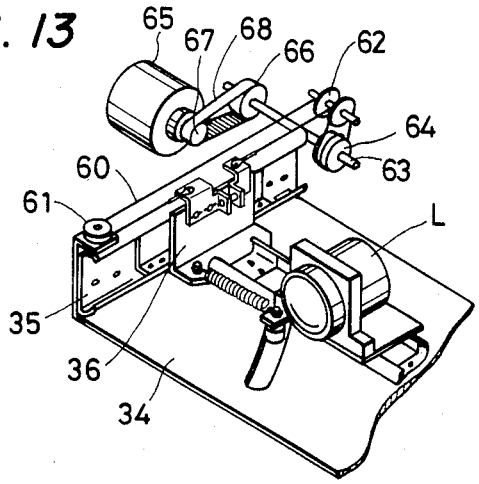
FIG. 13 is a perspective view showing another embodiment of the lens moving mechanism.

FIG. 13 shows another example of the lens moving mechanism constructed according to the present invention. The mechanism of FIG. 13 utilizes the feed screw, the nut 41, the wire, and the wire pulleys shown in FIG. 10. One end portion of the wire 60 is fastened to the platen 36 of the linear guide 35, thus allowing the lens L to move freely in the direction of the optical axis. The other end portion of the wire 60 is laid over a wire pulley 61, which is rotatably provided on the base plate 34, and a wire pulley 62. The wire pulley 62 is opposite the wire pulley 61 and is rotatably provided on the base plate 34. Furthermore, the other end portion of the wire rope 60 is sliplessly wound on a wire pulley 64 and secured to a rotary shaft 63 which is rotatably mounted on the base plate 34. The other end portion of the wire rope 60 is also laid over a wire pulley 66 which is coaxial with the wire pulley 62. Finally, the other end portion is fastened to the platen 36 in such a manner that the wire rope 60 is under tension. Timing pulleys 66 and 67 and a timing belt 68 are provided between the rotary shaft 63 and a stepping motor which is mounted on the copying machine body. The above-described lens moving mechanism, in which the driving wire is employed, is most applicable to a copying machine in which the lens moving distance is relatively long (i.e., the case where the feed screw is relatively long), and, accordingly, this machine is relatively expensive to manufacture.

Figure 14:
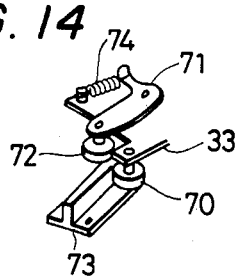
FIG. 14 is a perspective view showing one modification of a guide member.

FIG. 14 shows one modification of the roller 47 and the guide groove 48 in FIG. 10. A roller 70 is rotatably provided on the platen 33, and a movable roller 72 is provided on a plate-shaped lever 71 in such a manner that it confronts the roller 70. The lever 71 is rotatably mounted on the platen 33, and a lead rail 73, which has a T-shaped cross-section, is secured to the base plate 34 in such a manner that it is clamped by the roller 70 and the movable roller 72. A spring 74 is connected to the lever 71 under tension so that the roller 70 and the movable roller 72 are pressed against the lead rail 73. The lens moving mechanism employing the modification described above has more components than a mechanism utilizing the lead groove 48; however, in this modification, a reduced load is imposed when moving the lens L.

Figure 15:
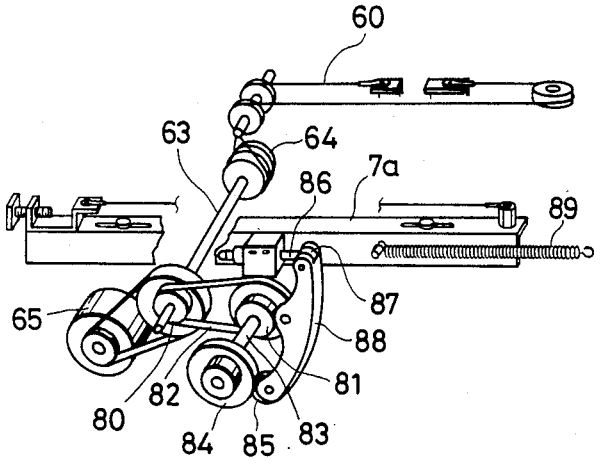
FIG. 15 is a perspective view showing a part of a copying machine in which the half-speed mirror moving mechanism and the lens moving mechanism is operated by the same motor.

In FIG. 15, the lens moving mechanism of FIG. 13 is utilized, and the stepping motor for the lens moving mechanism is used to move the lens and the half-speed mirrors so that a separate stepping motor for the half-speed mirror moving mechanism is not required. Accordingly, in this embodiment, only one stepping motor is required rather than two. A cam shaft 83 is rotated through timing pulleys 80 and 81 and a timing belt 82 by the rotary shaft 63, shown in FIG. 13. A plate-shaped cam 84, the phase of which can be adjusted, is mounted on the cam shaft 83, and a cam lever 88 is rockably provided on the copying machine body. The cam lever 88 has a cam follower 85 which is turned by pressing against the cam 84, and a roller 87, which abuts against an adjusting screw 86, is provided on a slide bar 7*c* similar to the embodiment shown in FIG. 7. A spring 89 is connected to the slide bar 7*c* so that the cam 84 and the roller 87 are pressed against the cam follower 85 and the adjusting screw 86, respectively. The angle of rotation of the cam shaft 83 is less than 360° (one revolution) with respect to the full stroke of the lens movement. The cam 84 curves so that the lens position described with reference to FIG. 5 corresponds exactly to the half-speed mirror scanning starting position.

In the case where one stepping motor is commonly employed for the half-speed mirror moving mechanism and the lens moving mechanism as described above, only one control circuit is provided for the motor, and, therefore, the entire circuit is simplified.

In the case of a copying machine which has several magnifications, such as a multi-magnification copying machine which has two or three different magnifications, separate pulse numbers, corresponding to the separate number of magnifications, are stored in the control device. In this case, only a part of the control circuit is modified; however, it is unnecessary to change the mechanical construction.

As is apparent from the above description, according to the present invention, in a copying machine which can continuously control the mirror scanning speed and the scanning distance according to specified magnifications, the position-controllable numerical control motor is employed to provide the half-speed mirror moving mechanism. According to the specified magnifications, the half-speed mirror scanning starting position is continuously moved to change the object-image distance, and the lens position is continuously moved to change the position of the lens. Therefore, an enlarging magnification can be changed into a contracting magnification continuously or discontinuously, and vice versa. Accordingly, a magnification can be specified as desired. A copy of a desired size can be obtained with a sheet other than a standard size sheet (such as size A or B). Because a zoom lens is not employed in the lens system, the copying machine requires fewer lenses than a machine utilizing a zoom lens. Thus, the copying machine is simple in construction and inexpensive to manufacture. Furthermore, since the half-speed mirror means is made up of two mirrors which are arranged perpendicular to each other, the optical axis on the surface of the original is not shifted, even in the case of a varied magnification; that is, it is unnecessary to correct the position of the optical axis when the magnification is varied. In addition, when an enlarging magnification is desired, the mirror scanning distance is reduced to a minimum since the half-speed mirror movement region and the lens movement region overlap. As a result, the enlarging magnification of the lens is increased without increasing the size of the copying machine.

Furthermore, according to the present invention, the mirror scanning drive pulley is provided with an electromagnetic brake. Therefore, undesirable collisions between the half-speed mirrors and the movement of the lens are prevented, even though the ranges of movement of these elements overlap.

We claim:

1. A continuous, variable magnification-type copying machine capable of enlarging and contracting an image, said copying machine having a stationary original placing plate, comprising; a full-speed mirror; means for moving said full-speed mirror to scan an original; a lens; means for moving said lens according to a desired magnification; a half-speed mirror system; means for moving said half-speed mirror system to a scanning starting position determined according to said desired magnification; said lens moving means and said half-speed mirror system moving means comprising numerical control motor means for controlling the scanning starting position of said half-speed mirror and the position of said lens in accordance with a desired magnification of said image; and means for continuously varying the full-speed and said half-speed mirror system scanning speeds according to said desired magnification.

2. The machine as claimed in claim 1 further comprising means for presetting scanning distances of said full-speed mirror and said half-speed mirror system to a minimum value as said magnification is changed.

3. The machine as claimed in claim 2 wherein a range of movement of said half-speed mirror overlaps a range of movement of said lens as said magnification of said image is varied.

4. The machine as claimed in claim 1 wherein said means for moving said full-speed mirror includes drive means and an electromagnetic brake for braking said drive means.

5. The machine as claimed in claim 1 further including drum moving means for rotating a photo-sensitive drum at a constant speed, regardless of the magnification of said image.

6. The machine as claimed in claim 4 wherein said half-speed mirror system moving means further comprises:

a slide bar;

a plurality of idler pulleys;

an endless wire interconnecting said slide bar, said drive means and said idler pulleys;

a plurality of timing pulleys, one of which is driven by said numerical control motor means;

an endless timing belt interconnecting said timing pulleys; and means for transmitting driving motion of said timing pulleys to said slide bar to move said half-speed mirror system.

7. The machine as claimed in claim 6 wherein said motion transmitting means comprises a feed screw.

8. The machine as claimed in claim 6 wherein said motion transmitting means comprises a worm wheel and a corresponding worm.

9. The machine as claimed in claim 1 wherein said lens moving means comprises:

lens holding means;

guide means for guiding movement of said lens holding means along an optical axis of said lens;

a plurality of timing pulleys, one of which is driven by said numerical control motor means;

an endless timing belt interconnecting said plurality of timing pulleys; and means for transmitting driving motion of said timing pulleys into movement of said lens holding means to move said lens.

10. The machine as claimed in claim 9 wherein said motion transmitting means comprises a feed screw.

11. The machine as claimed in claim 9 wherein said lens holding means comprises:

a platen having a slit;

means for adjusting a position of said slit on said platen along said optical axis;

said lens moving mechanism further comprising a photo-interruptor positioned in a vicinity of said slit for detecting a predetermined magnification position of said lens.

12. The machine as claimed in claim 11 wherein said predetermined magnification position is a life-size magnification position so that said photo-interruptor can detect whether a specified magnification is an enlarging magnification or a contracting magnification.

13. The machine as claimed in claim 11 further comprising means connected to said photo-interruptor for calculating a number of pulses to be supplied to said motor to move said lens along said optical axis a predetermined distance corresponding to a predetermined desired magnification.

14. The machine as claimed in claim 9 wherein said guide means also guides said lens holding means along a direction perpendicular to said optical axis, said motion transmitting means transmitting motion to said lens holding means so that said lens holding means is moved a predetermined distance along said perpendicular direction so that the image of one edge of an original is always formed at one location on an associated photo-sensitive drum regardless of the magnification thereof, said lens moving mechanism further comprising position determining means for determining when said lens holding means has been moved said predetermined distance along said perpendicular direction.

15. The machine as claimed in claim 14 wherein said guide means comprises a single linear guide member which guides said lens holding means along a predetermined straight line over a plurality of image magnifications.

16. The machine as claimed in claim 9 wherein said guide means comprises a single linear guide member which guides said lens holding means along a predetermined straight line over a plurality of image magnifications.

17. The machine as claimed in claim 14 wherein said guide means comprises two linear guide members which cooperate to move said lens holding means along a predetermined curved line over a plurality of lens magnification positions.

18. The machine as claimed in claim 1 further comprising cam means, said cam means including a cam shaft having a cam, said numerical control motor means comprising a single stepping motor, means connected to said single stepping motor for rotating said cam shaft, said cam means being connected to said single stepping motor so that said single stepping motor controls both said half-speed mirror system moving means and said lens moving means.

* * * * *